US005299915A

United States Patent [19]

Dinh et al.

[11] Patent Number: 5,299,915

[45] Date of Patent: Apr. 5, 1994

[54] BUCKET FOR THE LAST STAGE OF A STEAM TURBINE

[75] Inventors: Cuong V. Dinh, Schenectady; Steven G. Ruggles, Scotia, both of N.Y.

[73] Assignee: General Electric Corporation, Schenectady, N.Y.

[21] Appl. No.: 913,352

[22] Filed: Jul. 15, 1992

[51] Int. Cl.[5] ..... F01D 5/14

[52] U.S. Cl. ..... 416/223 A; 416/190; 416/191; 416/192; 416/193 A; 416/196 R; 416/DIG. 2; 415/181

[58] Field of Search ..... 415/181; 416/189 R, 416/190, 191, 192, 194, 195, 196 R, 223 A, DIG. 2, DIG. 5, 193 A

[56] References Cited

U.S. PATENT DOCUMENTS

| | | | |
|---|---|---|---|
| 1,842,957 | 1/1932 | Bassler | 416/190 |
| 2,197,334 | 4/1940 | Bohan | 416/191 |
| 3,367,629 | 2/1968 | Partington | 416/190 |
| 3,572,968 | 3/1971 | Musick | 416/190 |
| 4,682,935 | 7/1987 | Martin | 416/223 A |
| 4,695,228 | 9/1987 | Purcaru | 416/223 A |
| 4,878,811 | 11/1989 | Jorgensen | 416/193 A |
| 4,900,230 | 2/1990 | Patel . | |
| 5,088,894 | 2/1992 | Patel | 416/233 A |
| 5,160,242 | 11/1992 | Brown | 416/223 A |
| 5,767,274 | 8/1988 | Walter | 416/193 A |

FOREIGN PATENT DOCUMENTS

| | | | |
|---|---|---|---|
| 2356669 | 4/1975 | Fed. Rep. of Germany | 416/190 |
| 0018243 | 11/1969 | Japan | 416/191 |
| 0047103 | 4/1977 | Japan | 416/224 |
| 0002402 | 1/1982 | Japan | 416/193 A |
| 9162301 | 9/1984 | Japan | 416/191 |

*Primary Examiner*—Edward K. Look
*Assistant Examiner*—Christopher Verdier
*Attorney, Agent, or Firm*—Nixon & Vanderhye

[57] ABSTRACT

A last-stage steam turbine bucket having a profile according to Charts I-XXXXI of Table I.

The bucket is divided into a number of profile sections each of which is a predetermined radial distance from the root section. Each point on a profile section at the predetermined radial distance from the root is defined by an X-Y coordinate and a radius R along the arc of a circle connecting adjacent points.

9 Claims, 5 Drawing Sheets

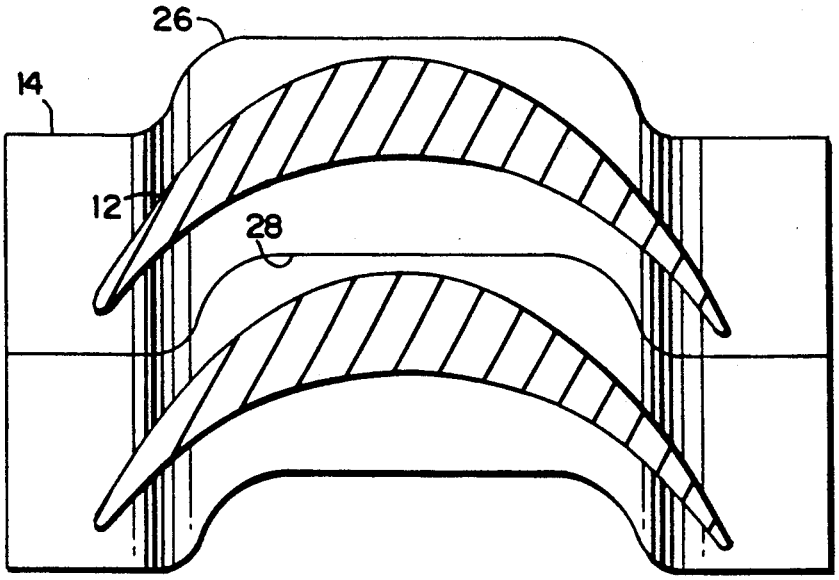
FIG. 3
FIG. 4
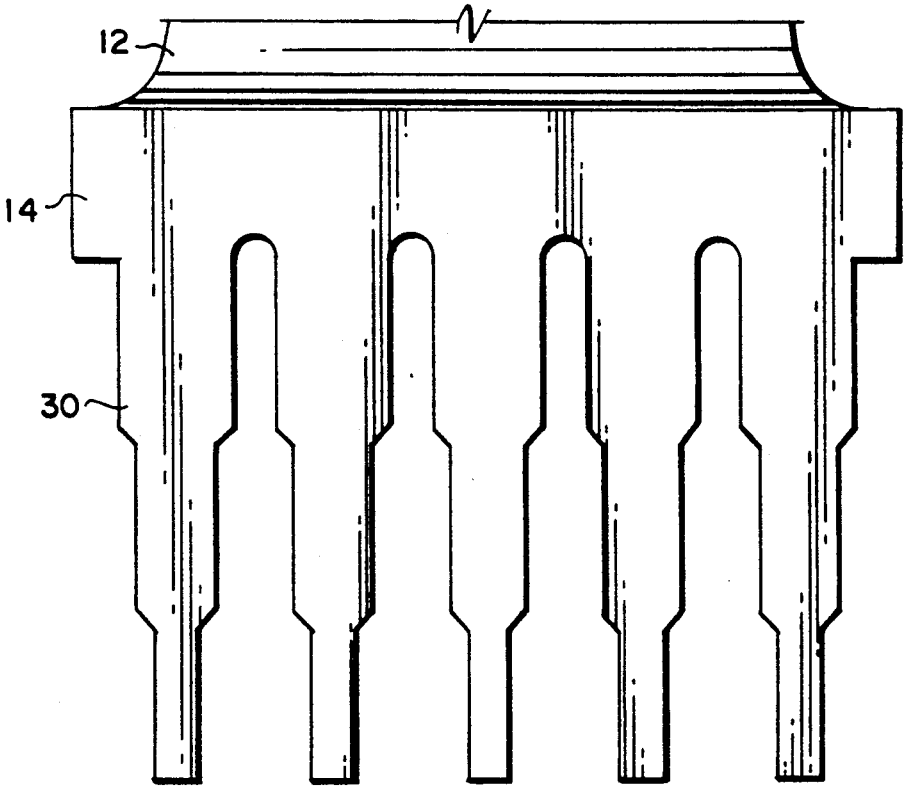

FIG. 5
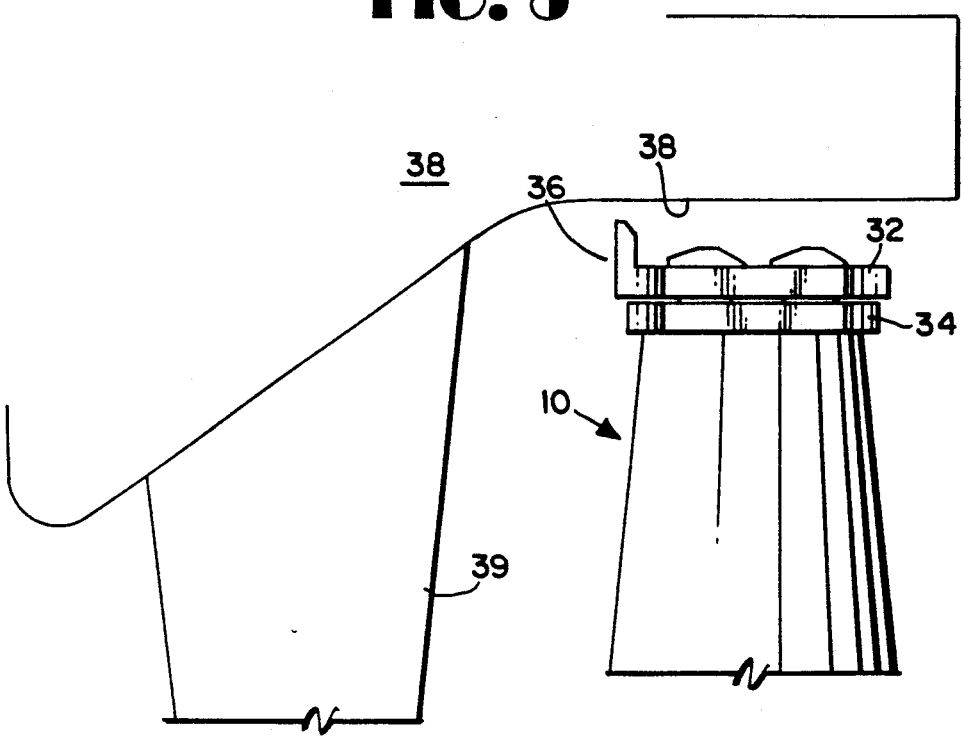
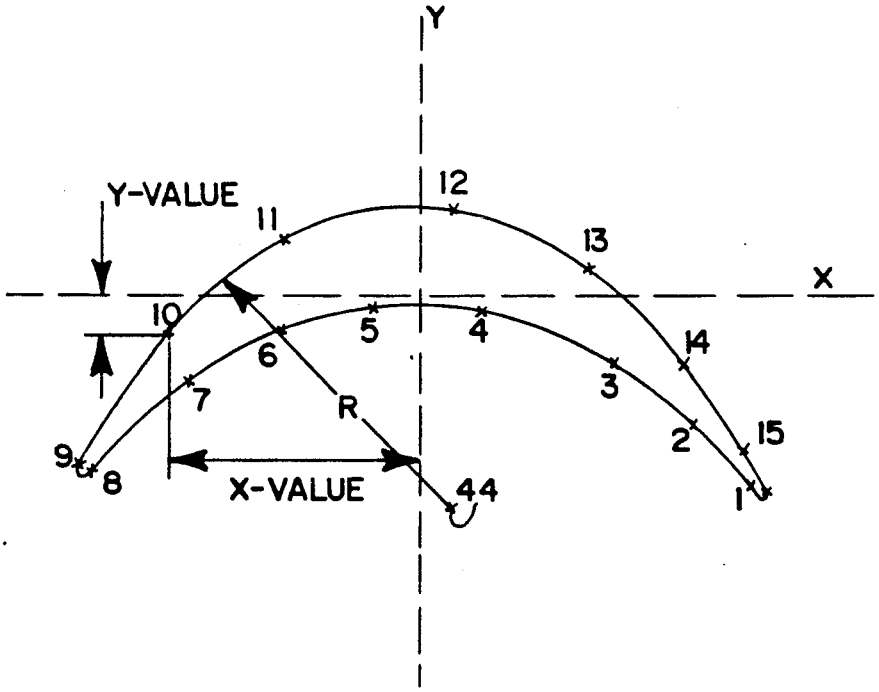
FIG. 10

FIG. 7
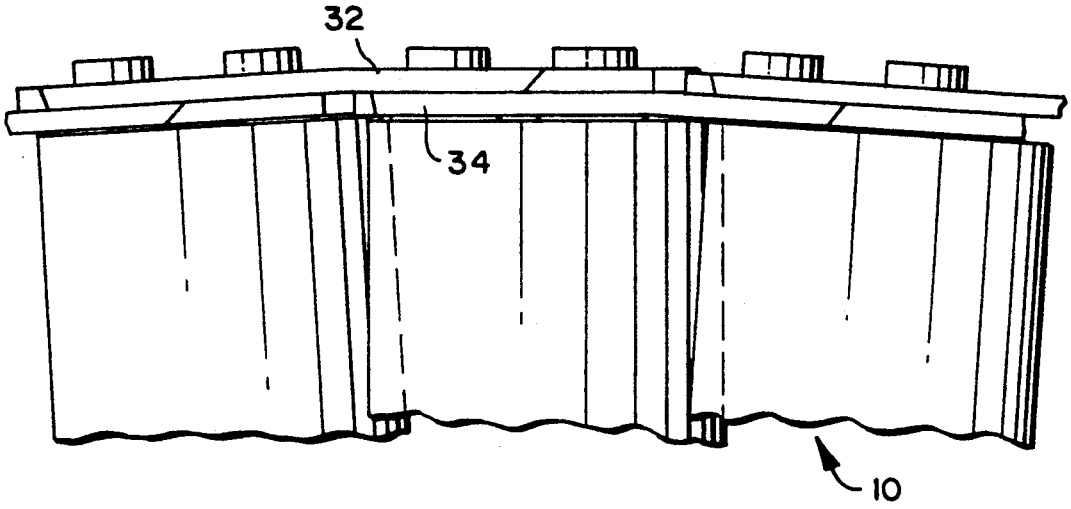
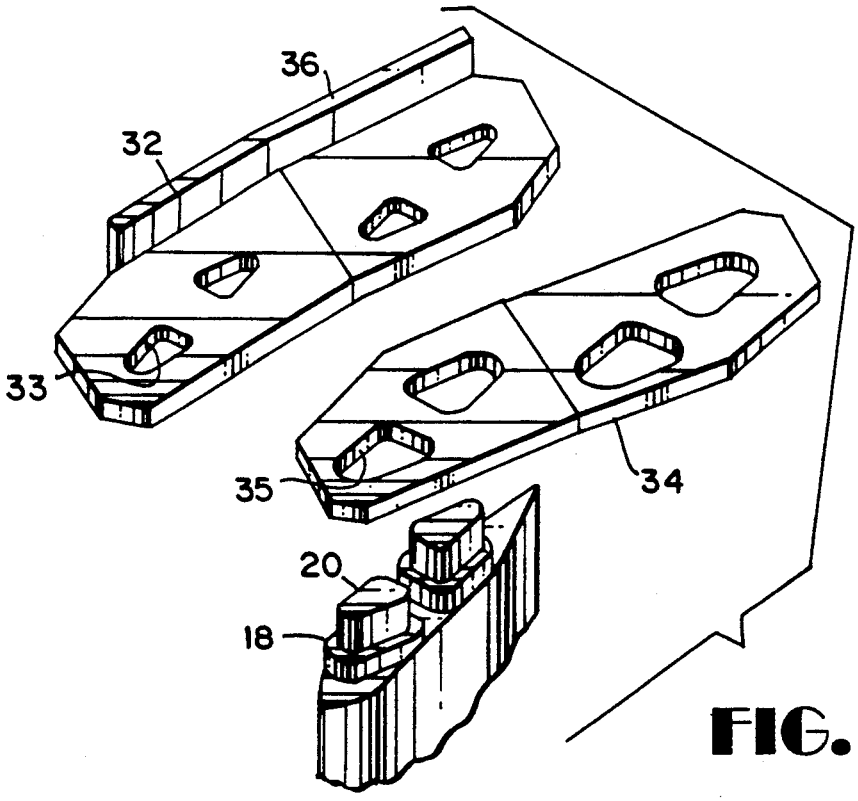
FIG. 6

BUCKET FOR THE LAST STAGE OF A STEAM TURBINE

TECHNICAL FIELD

The present invention relates to turbines, particularly steam turbines, and particularly relates to a last-stage steam turbine bucket having improved aerodynamic efficiency and mechanical reliability.

BACKGROUND

Last-stage buckets for steam turbines have for some time been the subject of substantial developmental work. It is highly desirable to optimize the performance of these later-stage buckets to reduce aerodynamic losses, particularly when it is recognized that the last stage of a steam turbine is the highest loaded stage and contributes on the order of about 10% to the overall output of the turbine. As will be appreciated, last-stage buckets are exposed to a wide range of flows, pressures, loads and strong dynamic forces. Optimally, the bucket profile should be designed to match aerodynamically the flow of the nozzle to provide the desirable operating characteristics over a large operating range. Factors which affect the final bucket profile include the active length of the bucket, its pitch diameter and its high operating speed in both supersonic and subsonic flows. Damping and bucket fatigue are factors which must be considered in the mechanical design of the bucket and its profile. The buckets must also be tuned to avoid coincidence between their natural frequencies and the flow stimuli. Additionally, the bucket profile must accommodate a smooth transition from subsonic flow adjacent the root to supersonic flow adjacent the blade tip. These mechanical and dynamic response properties of the buckets as well as others, such as thermodynamic properties or material selection all influence the optimum bucket profile. In brief, last-stage steam turbine buckets require a precisely defined bucket profile for optimal aerodynamic performance with minimum losses over a wide operating range.

Bucket designs in the past have included continuous coupling of the buckets at their outer tip employing under and over-covers as well as tiewires at intermediate stations along the buckets. These continuous couplings and tiewires are incorporated in the present bucket design to reduce bucket response to stimuli in the working fluid, which could cause uncontrolled vibration of the buckets, for example, at their natural frequencies. Vibration, of course, is to be minimized or eliminated to avoid fatigue and eventual structural failure and these continuous couplings and tiewires, of course, affect the aerodynamic properties of the buckets. It is important also to seal the tips of the buckets to minimize aerodynamic loss from flow passing around the bucket tips. The appropriate bucket profile is also important to provide converging-diverging flow passages between adjacent buckets and untwisting of the buckets from an ambient over-twisted configuration to a desired profile configuration at rated operation condition to achieve maximum aerodynamic efficiency.

DISCLOSURE OF INVENTION

In accordance with the present invention, there is provided a bucket profile design for the last-stage bucket of a steam turbine which affords significantly enhanced aerodynamic performance and efficiencies and reduced losses while providing for (1) transonic convergent-divergent supersonic flow passages; (2) bucket overtwist to account for untwist at operating speed to optimize efficiency; (3) covers having radial sealing ribs to minimize tip leakage losses; (4) improved root section aerodynamics with nesting of the bucket dovetails to conform with the vane root aerodynamic profile for better root flow efficiency; (5) substantially improved blade incidence loss; (6) reduced section edge thickness; and (7) optimized flow distribution. Various mechanical improvements are embodied in the present invention, including a continuously coupled over and under cover design for structurally coupling and damping the buckets to minimize vibration, and a loose tiewire connection at mid-bucket for added structural damping. The design, however, is dominated by the desired flow characteristics of the buckets for use in a particular environment and the present invention provides a particular bucket profile optimizing these objectives.

In a preferred embodiment according to the present invention, there is provided a bucket for a steam turbine having a profile in accordance with Charts I-XIX; XXI-XXXIX; and XLI inclusive of Table I.

In a further preferred embodiment according to the present invention, there is provided a bucket for a steam turbine having a profile in accordance with the Charts I-XVIII; and XX-XL inclusive of Table I.

Accordingly, it is a primary object of the present invention to provide a novel and improved bucket for the last stage of a steam turbine having improved aerodynamic performance.

BRIEF DESCRIPTION OF DRAWINGS

FIG. 3 is a cross-sectional view looking radially inwardly along the roots of a pair of buckets illustrating the nested finger dovetail design;

FIG. 4 is a fragmentary elevational view illustrating the dovetail fingers looking in a tangential direction;

FIG. 5 is a fragmentary view illustrating the outer and inner covers on the tip of the bucket and the tip leakage control;

FIG. 6 is a fragmentary perspective view illustrating the tip of the bucket and the outer and inner covers;

FIG. 7 is an axial view of a plurality of the bucket tips with the outer and inner covers attached;

FIG. 10 is a graph illustrating an airfoil section of the bucket profile as defined by the charts set forth in Table I of the following specification.

BEST MODE FOR CARRYING OUT THE INVENTION

Reference will now be made in detail to a present preferred embodiment of the invention, an example of which is illustrated in the accompanying drawings.

Figure 1:
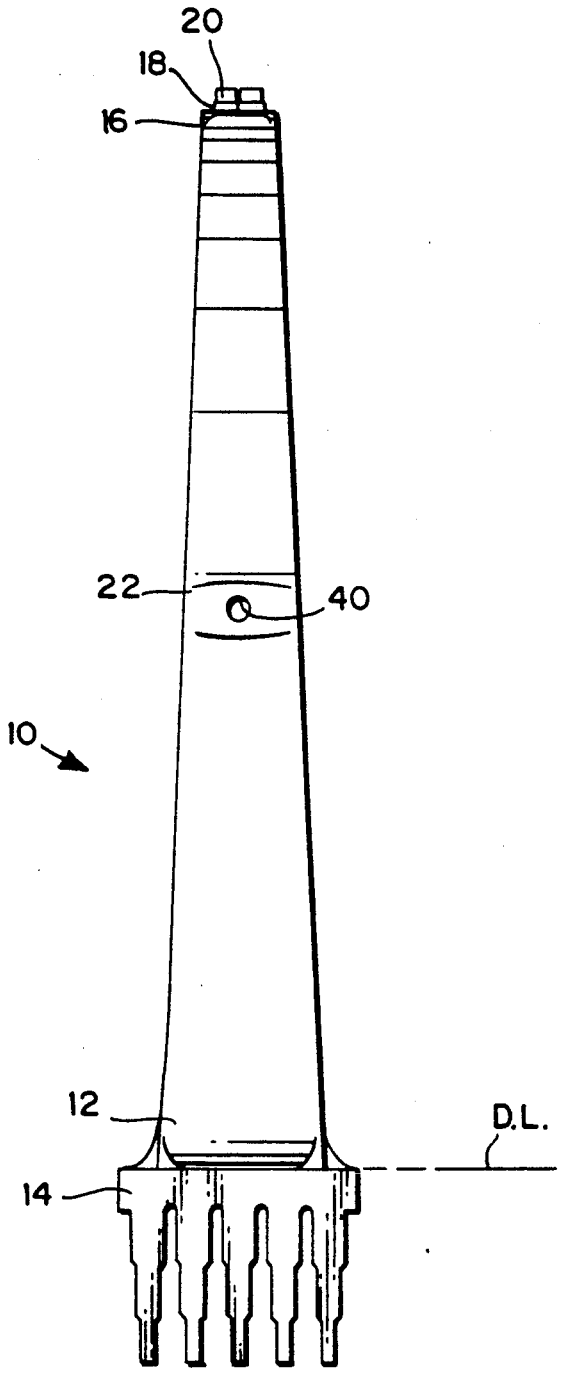
FIGS. 1 and 2 are tangential and axial views, respectively, of a bucket constructed in accordance with the present invention.
Figure 2:
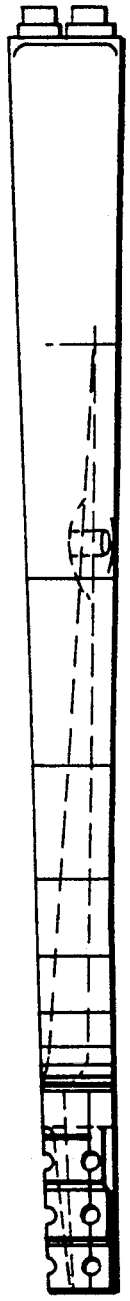

Referring to the drawing FIGS. 1 and 2, the bucket of the present invention is generally designated 10 and has a root section 12 connected to a finger dovetail 14 for connection to the wheel of the turbine, not shown. Bucket 10 also includes a tip 16 having radially projecting stepped tenons 18 and 20 for receiving inner and outer covers, respectively, as described hereinafter. Adjacent the midpoint of the bucket, there is provided a built-up section 22 having an aperture for receiving a tiewire 24 (FIG. 8), also as described hereinafter, adjacent the bucket's midpoints for structural damping. Referring particularly to FIGS. 3 and 4, the dovetails 14 have circumferentially projecting portions 26 between their opposite axial ends and corresponding circumferentially opening recesses 28 along their opposite sides. This enables the finger dovetails to nest one within the other to accommodate the extreme curvature of the root sections 12 of the buckets adjacent the finger dovetails as illustrated. The individual fingers 30 of the dovetail 14 are illustrated in FIG. 4, this type of connection being conventional.

Referring now to FIGS. 5–7, tip leakage control, as well as mechanical connections between adjacent blades to prevent aerodynamically excited vibrations at off design operating conditions as well as to afford damping and structural strength include outer and inner covers 32 and 34, respectively. Covers 32 and 34 form a continuously coupled connection at the blade tips to, among other things, reduce bucket vibration responsive to stimulus in the working fluid. The inner and outer covers alternate in their connection between the tips of adjacent buckets. Thus, the inner covers 34 have openings 35 which receive the larger tenons 18 on the ends of the tips of adjacent buckets, coupling those adjacent buckets one to the other. The outer cover has openings which receive the outer tenons 20 of one of the pair of coupled buckets and connects that one bucket with the adjacent bucket of an adjacent pair of buckets coupled by the inner cover 34. The tenons 20 are peened to secure the covers and buckets one to the other. Consequently, the inner and outer covers alternately couple adjacent buckets one to the other.

To afford tip leakage control between the buckets and the diaphragm 38, the outer cover is provided with a sealing lip 36 on the nozzle side of the turbine wheel, i.e., in axial opposition to the nozzle 39. The lip 36 projects radially outwardly with a small clearance from the diaphragm 38.

Figure 8:
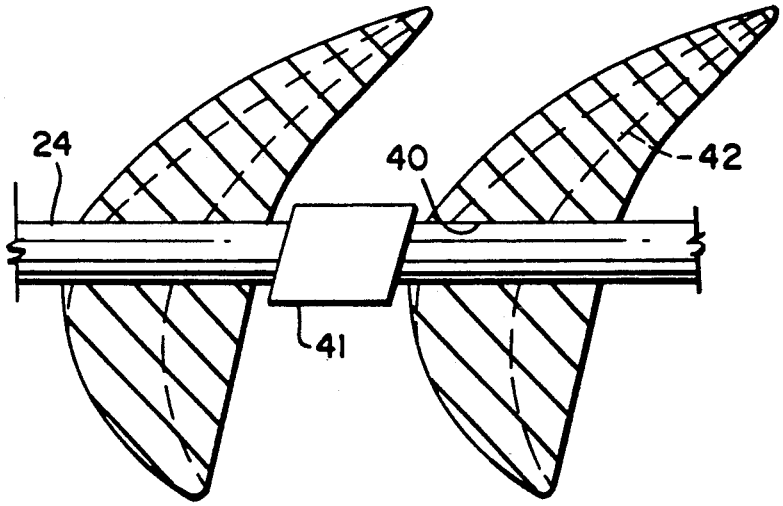
FIG. 8 is a cross-sectional view between a pair of buckets adjacent their tiewire midpoint illustrating the material build-up from the theoretical desired aerodynamic profile illustrated by the dashed lines to the actual profile.
Figure 9:
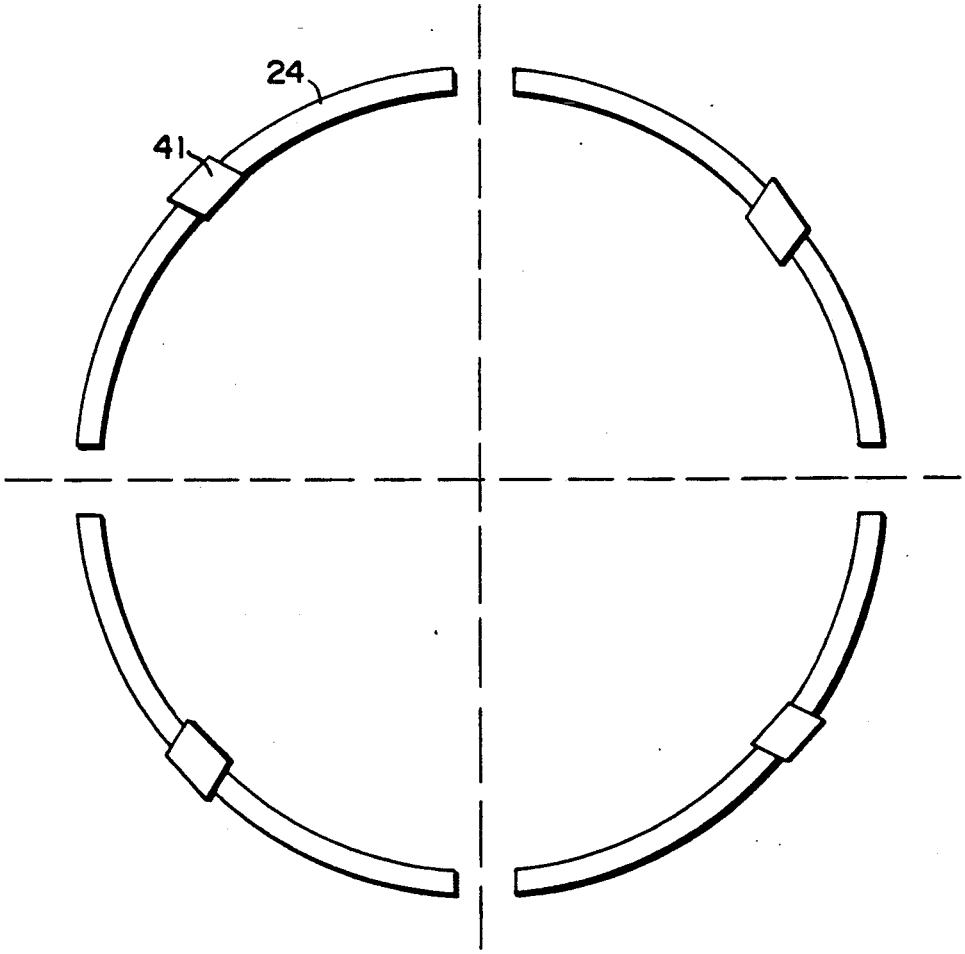
FIG. 9 is a schematic view representing the arrangement of the tiewires about the bucket wheel.

Referring now to FIGS. 8 and 9, buckets 10 are provided with an aperture 40 adjacent their mid-section for receiving the tiewire 24. Sleeves 41 are provided between the adjacent buckets on the tiewires and constitute enlargements against which the buckets may butt. FIG. 9 illustrates the arrangement of the tiewire 24 about the entire bucket wheel, with the sleeves 41 being illustrated at representative positions.

In FIG. 8, the dashed lines 42 within the outer surfaces of the pair of buckets illustrated represent the theoretical aerodynamically efficient cross-section for the bucket profile of the present invention at the radial distance from the bucket root corresponding to the aperture 40 for the tiewire. However, because of structural and mechanical reasons, the mid-section of each bucket is built-up about a half-inch radially on either side of the centerline of the aperture 40 to accommodate the tiewire and afford necessary mechanical strength to the bucket.

Referring now to FIG. 10, there is illustrated a representative bucket section profile at a predetermined radial distance from the root section. This radial distance is taken from a datum line D.L. at the intersection of the bucket root section 12 and the finger dovetail 14 as illustrated in FIG. 1. Each profile section at that radial distance is defined in X-Y coordinates by adjacent points identified by representative numerals 1 through 15 and which adjacent points are connected one to the other along the arcs of circles having radii R. For example, the arc connecting points 10 and 11 constitute a portion of a circle having a radius R and a center at 44 as illustrated. Values of the X-Y coordinates and the radii R for each bucket section profile taken at specific radial locations or heights from the root section of the bucket are tabulated in the following charts constituting Table I. The charts identify the various points along a profile section at the given radial distance from the root section by their X-Y coordinates and it will be seen that the charts have anywhere from 12 to 21 representative X-Y coordinate points, depending upon the profile section height from the root. These values are given in inches and represent actual bucket configuration at ambient non-operating conditions. The value for each radius R provides the length of the radius defining the arc of the circle between two of the adjacent points identified by the X-Y coordinates. The sign convention assigns a positive value to the radius R when the adjacent two points are connected in a clockwise direction and a negative value to the radius R when the adjacent two points are connected in a counterclockwise direction. By providing X-Y coordinates for spaced points about the blade profile at selected radial positions or heights from the root section and defining the radii of circles connecting adjacent points, the profile of the bucket is defined at each radial position and thus the bucket profile is defined throughout its entire length.

From a review of the following charts, it will be appreciated that there are two sets of X-Y coordinates and radii R for the bucket profile at both the 10-inch and 19.835 inch radial distances from the root section. The chart marked XIX marked "Build-up section" provides the X-Y coordinates and radii R of the actual bucket profile as thickened or built-up with bucket material from the desired theoretical aerodynamic profile at that distance from the root section. At the profile 10 inches from the root section, the build-up is provided about one-half inch radially on opposite sides of the axis of the apertures receiving the tiewire. That is, the bucket profile at the 10 inch distance from the root section is built up for a radial distance of one inch centered on the axis of the tiewire in accordance with those coordinates and radii. The other Chart XX at the profile section 10 inches from the root section provides the desired theoretical aerodynamic profile at that radial location. This theoretical aerodynamic profile is represented by the dashed lines in FIG. 8. Similarly, the tips of the buckets are built up for mechanical strength reasons. Accordingly, Chart XLI, designated as "Build-up section" provides X-Y coordinates and radii R for the actual bucket profile at the tip as built up. The theoretical desirable aerodynamic profile is provided by Chart XL at that same distance from the root. The radial extent of the built-up section at the tip is 0.875 inches.

It will be appreciated that having defined the profile of the bucket at various selected heights from the root, properties of the bucket such as the maximum and minimum moments of inertia, the area of the bucket at each section, the twist, torsional stiffness, sheer centers, vane width, can be ascertained.

TABLE I

CHART I
SECTION HT. FROM ROOT: 0.

| PT. NO. | X | Y | R |
|---|---|---|---|
| 1 | 1.5780 | −0.8924 | −2.7166 |
| 2 | 1.1759 | −0.4557 | −1.8000 |
| 3 | −1.0823 | −0.3687 | −2.0601 |
| 4 | −1.3141 | −0.5698 | −3.5761 |
| 5 | −1.4912 | −0.7619 | 0.1289 |
| 6 | −1.5271 | −0.7910 | 0.0246 |
| 7 | −1.5633 | −0.7660 | 0.1289 |
| 8 | −1.5462 | −0.7177 | 4.3669 |
| 9 | −1.1248 | −0.1318 | 1.9584 |
| 10 | −0.6240 | 0.2875 | 1.1600 |
| 11 | 0.1536 | 0.4303 | 1.5415 |
| 12 | 0.4407 | 0.3532 | 1.4204 |
| 13 | 0.8164 | 0.1423 | 2.2262 |
| 14 | 1.2047 | −0.2477 | 4.2694 |
| 15 | 1.6077 | −0.8738 | 0.0176 |
| 16 | 1.5780 | −0.8924 | 0. |

CHART II
SECTION HT. FROM ROOT: 1.500

| PT. NO. | X | Y | R |
|---|---|---|---|
| 1 | −1.3913 | −0.7036 | 0.0279 |
| 2 | −1.4320 | −0.6742 | 0.1656 |
| 3 | −1.4114 | −0.6814 | 3.9584 |
| 4 | −1.0035 | −0.0494 | 1.6472 |
| 5 | −0.5275 | 0.3310 | 0.9919 |
| 6 | 0.2414 | 0.3992 | 1.5434 |
| 7 | 0.8050 | 0.0737 | 2.6068 |
| 8 | 1.1676 | −0.3312 | 4.7197 |
| 9 | 1.5282 | −0.9155 | 0.0180 |
| 10 | 1.4977 | −0.9344 | −2.8131 |
| 11 | 0.9268 | −0.3501 | −1.7017 |
| 12 | 0.3639 | −0.0676 | −1.5622 |
| 13 | −0.9920 | −0.3404 | −2.7311 |
| 14 | −1.3490 | −0.6705 | 0.1571 |
| 15 | −1.3913 | −0.7036 | 0. |

CHART III
SECTION HT. FROM ROOT: 2.000

| PT. NO. | X | Y | R |
|---|---|---|---|
| 1 | 1.4716 | −0.9486 | −2.9291 |
| 2 | 0.9662 | −0.4108 | −1.7962 |
| 3 | 0.6225 | −0.1778 | −1.4500 |
| 4 | −0.1838 | −0.0204 | −1.4911 |
| 5 | −0.7167 | −0.1746 | −1.6522 |
| 6 | −1.0277 | −0.3791 | −3.2037 |
| 7 | −1.3089 | −0.6435 | 0.1532 |
| 8 | −1.3487 | −0.6738 | 0.0293 |
| 9 | −1.3913 | −0.6434 | 0.1532 |
| 10 | −1.3719 | −0.5894 | 3.9745 |
| 11 | −0.9843 | −0.0438 | 1.5934 |
| 12 | −0.6321 | 0.2658 | 1.1928 |
| 13 | −4.4548 | 0.3642 | 0.9400 |
| 14 | 0.1659 | 0.4164 | 1.2530 |
| 15 | 0.4393 | 0.3101 | 1.6674 |
| 16 | 0.7927 | 0.0583 | 2.5906 |
| 17 | 1.1320 | −0.3269 | 4.9204 |
| 18 | 1.5024 | −0.9295 | 0.0181 |
| 19 | 1.4716 | −0.9486 | 0. |

CHART IV
SECTION HT. FROM ROOT: 2.500

| PT. NO. | X | Y | R |
|---|---|---|---|
| 1 | −1.3090 | −0.6436 | 0.0296 |
| 2 | −1.3519 | −0.6117 | 0.1889 |
| 3 | −1.3298 | −0.5526 | 3.5275 |
| 4 | −0.9318 | 0.0018 | 1.4826 |
| 5 | −0.4964 | 0.3423 | 0.9239 |
| 6 | 0.2819 | 0.3742 | 1.5681 |
| 7 | 0.7771 | 0.0464 | 2.9758 |
| 8 | 1.1445 | −0.3901 | 5.1611 |
| 9 | 1.4769 | −0.9435 | 0.0183 |
| 10 | 1.4459 | −0.9626 | −3.0611 |
| 11 | 0.9891 | −0.4597 | 0. |
| 12 | 0.9339 | −0.4110 | −1.7945 |
| 13 | 0.6555 | −0.2096 | −1.4285 |
| 14 | −0.1074 | −0.0138 | −1.4448 |
| 15 | −0.9134 | −0.2987 | −2.7735 |
| 16 | −1.2655 | −0.6107 | 0.1677 |

TABLE I-continued

| | | | |
|---|---|---|---|
| 17 | −1.3090 | −0.6436 | 0. |

CHART V
SECTION HT. FROM ROOT: 3.000

| PT. NO. | X | Y | R |
|---|---|---|---|
| 1 | −1.2713 | −0.6127 | 0.0304 |
| 2 | −1.3152 | −0.5800 | 0.1880 |
| 3 | −1.2934 | −0.5213 | 3.4103 |
| 4 | −0.9168 | 0.0077 | 1.4445 |
| 5 | −0.5012 | 0.3383 | 0.9024 |
| 6 | 0.3017 | 0.3591 | 1.5912 |
| 7 | 0.7819 | 0.0148 | 3.3925 |
| 8 | 1.1577 | −0.4566 | 5.4984 |
| 9 | 1.4519 | −0.9575 | 0.0184 |
| 10 | 1.4206 | −0.9767 | −3.2051 |
| 11 | 0.9839 | −0.4846 | 0. |
| 12 | 0.9234 | −0.4291 | −1.8240 |
| 13 | 0.6290 | −0.2094 | −1.3833 |
| 14 | −0.1994 | −0.0173 | −1.3882 |
| 15 | −0.8677 | −0.2702 | −2.6732 |
| 16 | −1.2272 | −0.5798 | 0.1731 |
| 17 | −1.2713 | −0.6127 | 0. |

CHART VI
SECTION HT. FROM ROOT: 3.500

| PT. NO. | X | Y | R |
|---|---|---|---|
| 1 | −1.2355 | −0.5813 | 0.0311 |
| 2 | −1.2803 | −0.5479 | 0.1874 |
| 3 | −1.2586 | −0.4893 | 3.3830 |
| 4 | −0.9263 | −0.0126 | 1.4818 |
| 5 | −0.5227 | 0.3257 | 0.8807 |
| 6 | 0.3029 | 0.3511 | 1.5587 |
| 7 | 0.7579 | 0.0120 | 3.6609 |
| 8 | 1.1487 | −0.4913 | 5.8736 |
| 9 | 1.4273 | −0.9714 | 0.0185 |
| 10 | 1.3958 | −0.9907 | −3.3586 |
| 11 | 0.9750 | −0.5058 | 0. |
| 12 | 0.9132 | −0.4470 | −1.7934 |
| 13 | 0.5291 | −0.1684 | −1.3148 |
| 14 | −0.2507 | −0.0198 | −1.3429 |
| 15 | −0.8329 | −0.2478 | −2.5916 |
| 16 | −1.1915 | −0.5490 | 0.1760 |
| 17 | −1.2355 | −0.5813 | 0. |

CHART VII
SECTION HT. FROM ROOT: 4.000

| PT. NO. | X | Y | R |
|---|---|---|---|
| 1 | 1.3712 | −1.0045 | −3.5186 |
| 2 | 0.9268 | −0.4887 | −1.9953 |
| 3 | 0.6184 | −0.2359 | −1.3900 |
| 4 | 0.1231 | −0.0308 | −1.1727 |
| 5 | −0.5549 | −0.0963 | −1.4966 |
| 6 | −0.8790 | −0.2800 | −2.8055 |
| 7 | −1.1605 | −0.5202 | 0.1676 |
| 8 | −1.2012 | −0.5494 | 0.0320 |
| 9 | −1.2473 | −0.5155 | 0.1676 |
| 10 | −1.2271 | −0.4598 | 3.6724 |
| 11 | −0.9758 | −0.0834 | 1.7614 |
| 12 | −0.7357 | 0.1741 | 1.2583 |
| 13 | −0.4862 | 0.3448 | 0.8500 |
| 14 | 0.2846 | 0.3517 | 1.4982 |
| 15 | 0.6993 | 0.0465 | 3.0793 |
| 16 | 0.9591 | −0.2631 | 4.9647 |
| 17 | 1.2053 | −0.6328 | 6.3439 |
| 18 | 1.4029 | −0.9851 | 0.0186 |
| 19 | 1.3712 | −1.0045 | 0. |

CHART VIII
SECTION HT. FROM ROOT: 4.500

| PT. NO. | X | Y | R |
|---|---|---|---|
| 1 | −1.1692 | −0.5173 | 0.0319 |
| 2 | −1.2148 | −0.4820 | 0.2119 |
| 3 | −1.1912 | −0.4206 | 3.1160 |
| 4 | −0.8743 | 0.0310 | 1.3201 |
| 5 | −0.4948 | 0.3402 | 0.8266 |
| 6 | 0.3042 | 0.3345 | 1.6035 |
| 7 | 0.7417 | −0.0260 | 4.3444 |
| 8 | 1.1132 | −0.5342 | 6.7987 |
| 9 | 1.3789 | −0.9990 | 0.0187 |
| 10 | 1.3469 | −1.0183 | −3.6753 |
| 11 | 0.8956 | −0.4871 | 0. |

TABLE I-continued

| | | | |
|---|---|---|---|
| 12 | 0.8482 | −0.4410 | −1.7066 |
| 13 | 0.4021 | −0.1283 | −1.2122 |
| 14 | −0.2409 | −0.0125 | −1.2343 |
| 15 | −0.7685 | −0.2028 | −2.3788 |
| 16 | −1.1252 | −0.4861 | 0.1792 |
| 17 | −1.1692 | −0.5173 | 0. |

CHART IX
SECTION HT. FROM ROOT: 5.000

| PT. NO. | X | Y | R |
|---|---|---|---|
| 1 | −1.1385 | −0.4845 | 0.0324 |
| 2 | −1.1845 | −0.4485 | 0.2106 |
| 3 | −1.1608 | −0.3878 | 3.0391 |
| 4 | −0.8367 | 0.0674 | 1.1952 |
| 5 | −0.4637 | 0.3575 | 0.7978 |
| 6 | 0.3057 | 0.3254 | 1.6863 |
| 7 | 0.7450 | −0.0593 | 4.8415 |
| 8 | 1.0943 | −0.5540 | 7.4497 |
| 9 | 1.3550 | −1.0126 | 0.0188 |
| 10 | 1.3228 | −1.0320 | −3.8217 |
| 11 | 0.8816 | −0.5015 | 0. |
| 12 | 0.8485 | −0.4683 | −1.8602 |
| 13 | 0.4390 | −0.1582 | −1.2008 |
| 14 | −0.2071 | −0.0071 | −1.1721 |
| 15 | −0.7400 | −0.1810 | −2.2516 |
| 16 | −1.0945 | −0.4540 | 0.1801 |
| 17 | −1.1385 | −0.4845 | 0. |

CHART X
SECTION HT. FROM ROOT: 5.500

| PT. NO. | X | Y | R |
|---|---|---|---|
| 1 | −1.1097 | −0.4515 | 0.0328 |
| 2 | −1.1559 | −0.4148 | 0.2090 |
| 3 | −1.1322 | −0.3547 | 2.9574 |
| 4 | −0.8078 | 0.0951 | 1.1097 |
| 5 | −0.4406 | 0.3707 | 0.7700 |
| 6 | 0.3058 | 0.3169 | 1.7886 |
| 7 | 0.7469 | −0.0928 | 5.3890 |
| 8 | 1.0664 | −0.5591 | 8.3128 |
| 9 | 1.3313 | −1.0261 | 0.0189 |
| 10 | 1.2989 | −1.0455 | −3.7895 |
| 11 | 0.7825 | −0.4322 | −1.8612 |
| 12 | 0.4172 | −0.1590 | −1.1769 |
| 13 | −0.1978 | −0.0043 | −1 1312 |
| 14 | −0.7343 | −0.1709 | −2.1821 |
| 15 | −1.0661 | −0.4219 | 0.1804 |
| 16 | −1.1097 | −0.4515 | 0. |

CHART XI
SECTION HT. FROM ROOT: 6.000

| PT. NO. | X | Y | R |
|---|---|---|---|
| 1 | 1.2751 | −1.0593 | −4.5171 |
| 2 | 1.0251 | −0.7239 | −3.0609 |
| 3 | 0.7922 | −0.4704 | −2.0563 |
| 4 | 0.4872 | −0.2168 | −1.2900 |
| 5 | 0.0750 | −0.0321 | −1.0279 |
| 6 | −0.5286 | −0.0642 | −1.2685 |
| 7 | −0.8164 | −0.2140 | −2.5006 |
| 8 | −1.0424 | −0.3914 | 0.1744 |
| 9 | −1.0827 | −0.4181 | 0.0333 |
| 10 | −1.1297 | −0.3815 | 0.1744 |
| 11 | −1.1084 | −0.3264 | 3.0829 |
| 12 | −0.8138 | 0.0856 | 1.1498 |
| 13 | −0.5515 | 0.3140 | 0.9362 |
| 14 | −0.4030 | 0.3904 | 0.7400 |
| 15 | 0.2919 | 0.3164 | 1.8189 |
| 16 | 0.7037 | −0.0700 | 4.4279 |
| 17 | 0.9673 | −0.4478 | 9.7217 |
| 18 | 1.3078 | −1.0396 | 0.0191 |
| 19 | 1.2751 | −1.0593 | 0. |

CHART XII
SECTION HT. FROM ROOT: 6.500

| PT. NO. | X | Y | R |
|---|---|---|---|
| 1 | −1.0586 | −0.3845 | 0.0328 |
| 2 | −1.1045 | −0.3475 | 0.2048 |
| 3 | −1.0809 | −0.2888 | 2.7082 |
| 4 | −0.7624 | 0.1422 | 1.0016 |
| 5 | −0.4291 | 0.3842 | 0.7203 |
| 6 | 0.2911 | 0.3078 | 1.9623 |
| 7 | 0.7357 | −0.1454 | 6.8301 |

TABLE I-continued

| | | | |
|---|---|---|---|
| 8 | 1.0341 | −0.6078 | 12.3436 |
| 9 | 1.2844 | −1.0530 | 0.0192 |
| 10 | 1.2514 | −1.0727 | −4.4963 |
| 11 | 0.9680 | −0.6916 | −2.8668 |
| 12 | 0.5416 | −0.2745 | −1.3503 |
| 13 | 0.1265 | −0.0507 | −1.0294 |
| 14 | −0.7133 | −0.1380 | −1.8885 |
| 15 | −1.0161 | −0.3565 | 0.1793 |
| 16 | −1.0586 | −0.3845 | 0. |

CHART XIII
SECTION HT. FROM ROOT: 7.000

| PT. NO. | X | Y | R |
|---|---|---|---|
| 1 | −1.0360 | −0.3505 | 0.0325 |
| 2 | −1.0814 | −0.3136 | 0.2025 |
| 3 | −1.0581 | −0.2559 | 2.5436 |
| 4 | −0.7550 | 0.1519 | 1.0218 |
| 5 | −0.4625 | 0.3747 | 0.6979 |
| 6 | 0.2748 | 0.3088 | 2.0022 |
| 7 | 0.7196 | −0.1582 | 7.9045 |
| 8 | 1.1148 | −0.8008 | 0. |
| 9 | 1.2612 | −1.0665 | 0.0193 |
| 10 | 1.2282 | −1.0862 | −4.2255 |
| 11 | 0.9770 | −0.7387 | −3.1421 |
| 12 | 0.5817 | −0.3291 | −1.5464 |
| 13 | 0.1625 | −0.0705 | −1.0000 |
| 14 | −0.7109 | −0.1230 | −1.6945 |
| 15 | −0.9940 | −0.3232 | 0.1783 |
| 16 | −1.0360 | −0.3505 | 0. |

CHART XIV
SECTION HT. FROM ROOT: 7.500

| PT. NO. | X | Y | R |
|---|---|---|---|
| 1 | −1.0146 | −0.3159 | 0.0323 |
| 2 | −1.0595 | −0.2791 | 0.2001 |
| 3 | −1.0362 | −0.2223 | 2.4284 |
| 4 | −0.7491 | 0.1619 | 1.0307 |
| 5 | −0.4799 | 0.3724 | 0.6753 |
| 6 | 0.2554 | 0.3130 | 2.0031 |
| 7 | 0.6986 | −0.1636 | 9.0133 |
| 8 | 1.0780 | −0.7888 | 0. |
| 9 | 1.2388 | −1.0798 | 0.0194 |
| 10 | 1.2054 | −1.0996 | −4.1274 |
| 11 | 0.9540 | −0.7471 | −3.2437 |
| 12 | 0.5817 | −0.3522 | −1.6541 |
| 13 | 0.1517 | −0.0732 | −0.9716 |
| 14 | −0.7060 | −0.1054 | −1.5016 |
| 15 | −0.9729 | −0.2892 | 0.1773 |
| 16 | −1.0146 | −0.3159 | 0. |

CHART XV
SECTION HT. FROM ROOT: 8.000

| PT. NO. | X | Y | R |
|---|---|---|---|
| 1 | 1.1834 | −1.1129 | −4.4571 |
| 2 | 0.8450 | −0.6500 | −2.7432 |
| 3 | 0.5196 | −0.3210 | −1.6515 |
| 4 | 0.1167 | −0.0643 | −0.9400 |
| 5 | −0.6799 | −0.0766 | −1.0973 |
| 6 | −0.7825 | −0.1335 | −1.7729 |
| 7 | −0.9565 | −0.2578 | 0.1703 |
| 8 | −0.9935 | −0.2807 | 0.0325 |
| 9 | −1.0386 | −0.2440 | 0.1703 |
| 10 | −1.0173 | −0.1914 | 2.5455 |
| 11 | −0.7757 | 0.1376 | 1.1118 |
| 12 | −0.4964 | 0.3697 | 0.6500 |
| 13 | 0.2263 | 0.3252 | 1.8268 |
| 14 | 0.5330 | 0.0282 | 2.5033 |
| 15 | 0.6914 | −0.1888 | 8.2617 |
| 16 | 0.9455 | −0.6056 | 11.9982 |
| 17 | 0.9905 | −0.6852 | 72.1077 |
| 18 | 1.2170 | −1.0930 | 0.0195 |
| 19 | 1.1834 | −1.1129 | 0. |

CHART XVI
SECTION HT. FROM ROOT: 8.500

| PT. NO. | X | Y | R |
|---|---|---|---|
| 1 | −0.9730 | −0.2447 | 0.0323 |
| 2 | −1.0172 | −0.2070 | 0.1980 |
| 3 | −0.9938 | −0.1523 | 2.2084 |
| 4 | −0.7253 | 0.1974 | 0.9657 |
| 5 | −0.4739 | 0.3890 | 0.6352 |

TABLE I-continued

| | | | |
|---|---|---|---|
| 6 | 0.2295 | 0.3162 | 2.0816 |
| 7 | 0.6602 | −0.1752 | 11.4589 |
| 8 | 0.9954 | −0.7431 | 0. |
| 9 | 1.1957 | −1.1059 | 0.0196 |
| 10 | 1.1620 | −1.1259 | −6.1452 |
| 11 | 1.0159 | −0.9071 | −3.5384 |
| 12 | 0.5862 | −0.4011 | −1.8608 |
| 13 | 0.1302 | −0.0745 | −0.9247 |
| 14 | −0.7012 | −0.0713 | −1.2569 |
| 15 | −0.9321 | −0.2198 | 0.1780 |
| 16 | −0.9730 | −0.2447 | 0. |

CHART XVII
SECTION HT. FROM ROOT: 9.000

| PT. NO. | X | Y | R |
|---|---|---|---|
| 1 | −0.9520 | −0.2075 | 0.0327 |
| 2 | −0.9961 | −0.1687 | 0.1983 |
| 3 | −0.9724 | −0.1153 | 2.0981 |
| 4 | −0.7014 | 0.2273 | 0.8804 |
| 5 | −0.4330 | 0.4150 | 0.6054 |
| 6 | 0.1765 | 0.3490 | 1.1753 |
| 7 | 0.2941 | 0.2490 | 2.3354 |
| 8 | 0.6662 | −0.2184 | 14.4810 |
| 9 | 0.9689 | −0.7433 | 0. |
| 10 | 1.1750 | −1.1185 | 0.0198 |
| 11 | 1.1411 | −1.1388 | 0. |
| 12 | 1.0564 | −1.0083 | −3.7319 |
| 13 | 0.5798 | −0.4162 | −1.9042 |
| 14 | 0.1085 | −0.0679 | −0.8999 |
| 15 | −0.6776 | −0.0445 | −1.1821 |
| 16 | −0.9118 | −0.1843 | 0.1801 |
| 17 | −0.9520 | −0.2075 | 0. |

CHART XVIII
SECTION HT. FROM ROOT: 9.500

| PT. NO. | X | Y | R |
|---|---|---|---|
| 1 | −0.9309 | −0.1689 | 0.0332 |
| 2 | −0.9748 | −0.1286 | 0.1987 |
| 3 | −0.9503 | −0.0758 | 2.0679 |
| 4 | −0.6814 | 0.2532 | 0.8037 |
| 5 | −0.3914 | 0.4380 | 0.5801 |
| 6 | 0.1323 | 0.3747 | 0.9389 |
| 7 | 0.2720 | 0.2596 | 2.4592 |
| 8 | 0.6468 | −0.2224 | 15.8437 |
| 9 | 0.9436 | −0.7436 | 0. |
| 10 | 1.1546 | −1.1312 | 0.0198 |
| 11 | 1.1206 | −1.1514 | 0. |
| 12 | 1.0210 | −0.9973 | −3.8173 |
| 13 | 0.5684 | −0.4256 | −1.9548 |
| 14 | 0.0964 | −0.0646 | −0.8851 |
| 15 | −0.6518 | −0.0173 | −1.1070 |
| 16 | −0.8912 | −0.1474 | 0.1826 |
| 17 | −0.9309 | −0.1689 | 0. |

CHART XIX
SECTION HT. FROM ROOT: 10.000

| PT. NO. | X | Y | R |
|---|---|---|---|
| 1 | −0.9291 | −0.1296 | 0.0340 |
| 2 | −0.9534 | −0.0868 | 0.1780 |
| 3 | −0.9292 | −0.0367 | 2.2000 |
| 4 | −0.6871 | 0.2544 | 0.8361 |
| 5 | −0.1366 | 0.5014 | 0.6000 |
| 6 | 0.1470 | 0.4467 | 1.0000 |
| 7 | 0.5243 | 0.1427 | 3.5000 |
| 8 | 1.1358 | −1.1483 | 0.0200 |
| 9 | 1.1023 | −1.1671 | 0. |
| 10 | 0.6303 | −0.6951 | −1.2000 |
| 11 | 0.0720 | −0.3793 | 0. |
| 12 | −0.9291 | −0.1296 | 0. |
| | (Build-up section) | | |

CHART XX
SECTION HT. FROM ROOT: 10.000

| PT. NO. | X | Y | R |
|---|---|---|---|
| 1 | 1.0998 | −1.1641 | 4.1172 |
| 2 | 1.0268 | −1.0508 | −4.1172 |
| 3 | 0.8685 | −0.8145 | −3.8793 |
| 4 | 0.5399 | −0.4177 | −1.9522 |
| 5 | 0.0796 | −0.0584 | −0.8747 |
| 6 | −0.6898 | −0.0149 | −1.2706 |
| 7 | −0.8748 | −0.1117 | 0.1782 |

TABLE I-continued

| | | | |
|---|---|---|---|
| 8 | −0.9092 | −0.1286 | 0.0340 |
| 9 | −0.9534 | −0.0867 | 0.1782 |
| 10 | −0.9292 | −0.0367 | 2.2003 |
| 11 | −0.6873 | 0.2541 | 0.8361 |
| 12 | −0.4731 | 0.4110 | 0.6117 |
| 13 | −0.2103 | 0.4783 | 0.5341 |
| 14 | 0.0365 | 0.4261 | 0.7362 |
| 15 | 0.2415 | 0.2800 | 2.3756 |
| 16 | 0.5275 | −0.0704 | 4.3683 |
| 17 | 0.6652 | −0.2902 | 12.8078 |
| 18 | 0.8916 | −0.6932 | 0. |
| 19 | 1.1340 | −1.1435 | 0.0200 |
| 20 | 1.0998 | −1.1641 | 0. |

CHART XXI
SECTION HT. FROM ROOT: 10.500

| PT. NO. | X | Y | R |
|---|---|---|---|
| 1 | −0.8878 | −0.0866 | 0.0342 |
| 2 | −0.9306 | −0.0424 | 0.2195 |
| 3 | −0.9013 | 0.0126 | 2.0443 |
| 4 | −0.6365 | 0.3086 | 0.6742 |
| 5 | −0.3284 | 0.4701 | 0.5491 |
| 6 | 0.1093 | 0.3829 | 0.9654 |
| 7 | 0.2858 | 0.2220 | 3.0670 |
| 8 | 0.6061 | −0.2292 | 17.6031 |
| 9 | 0.9411 | −0.8317 | 0. |
| 10 | 1.1131 | −1.1559 | 0.0201 |
| 11 | 1.0788 | −1.1765 | 2.5202 |
| 12 | 1.0110 | −1.0707 | −4.2053 |
| 13 | 0.5840 | −0.4860 | −2.2047 |
| 14 | 0.1157 | −0.0811 | −0.9174 |
| 15 | −0.4018 | 0.0647 | −0.9545 |
| 16 | −0.8500 | −0.0693 | 0.1887 |
| 17 | −0.8878 | −0.0866 | 0. |

CHART XXII
SECTION HT. FROM ROOT: 11.000

| PT. NO. | X | Y | R |
|---|---|---|---|
| 1 | −0.8658 | −0.0436 | 0.0351 |
| 2 | −0.9083 | 0.0029 | 0.2184 |
| 3 | −0.8771 | 0.0573 | 2.0831 |
| 4 | −0.6179 | 0.3329 | 0.6324 |
| 5 | −0.3525 | 0.4730 | 0.5464 |
| 6 | 0.1182 | 0.3726 | 1.0935 |
| 7 | 0.3054 | 0.1845 | 3.5489 |
| 8 | 0.5765 | −0.2177 | 18.5392 |
| 9 | 0.9706 | −0.9348 | 0. |
| 10 | 1.0923 | −1.1684 | 0.0198 |
| 11 | 1.0580 | −1.1881 | 0. |
| 12 | 0.9336 | −0.9902 | −4.4849 |
| 13 | 0.6585 | −0.6003 | −2.8186 |
| 14 | 0.3561 | −0.2735 | −1.8683 |
| 15 | 0.0723 | −0.0580 | −0.9052 |
| 16 | −0.8293 | −0.0288 | 0.1924 |
| 17 | −0.8658 | −0.0436 | 0. |

CHART XXIII
SECTION HT. FROM ROOT: 11.500

| PT. NO. | X | Y | R |
|---|---|---|---|
| 1 | −0.8439 | −0.0012 | 0.0362 |
| 2 | −0.8857 | 0.0487 | 0.2431 |
| 3 | −0.8514 | 0.1038 | 1.9647 |
| 4 | −0.5909 | 0.3645 | 0.5921 |
| 5 | −0.4508 | 0.4509 | 0.5429 |
| 6 | 0.1141 | 0.3711 | 1.1462 |
| 7 | 0.3054 | 0.1681 | 3.7395 |
| 8 | 0.5262 | −0.1693 | 18.1674 |
| 9 | 0.9903 | −1.0212 | 0. |
| 10 | 1.0715 | −1.1801 | 0.0204 |
| 11 | 1.0366 | −1.2009 | 1.3061 |
| 12 | 0.9828 | −1.1161 | −4.9223 |
| 13 | 0.6416 | −0.6057 | −2.6912 |
| 14 | 0.2142 | −0.1617 | −1.2577 |
| 15 | −0.0598 | 0.0104 | −0.8971 |
| 16 | −0.8096 | 0.0109 | 0.1985 |
| 17 | −0.8439 | −0.0012 | 0. |

CHART XXIV
SECTION HT. FROM ROOT: 12.000

| PT. NO. | X | Y | R |
|---|---|---|---|
| 1 | 1.0164 | −1.2128 | 0. |

TABLE I-continued

| | | | |
|---|---|---|---|
| 2 | 0.9921 | −1.1773 | 0.3963 |
| 3 | 0.9742 | −1.1487 | −5.2024 |
| 4 | 0.6145 | −0.5977 | −2.6362 |
| 5 | 0.4403 | −0.3881 | −2.7001 |
| 6 | 0.1875 | −0.1474 | −1.8888 |
| 7 | −0.1589 | 0.0542 | −0.8817 |
| 8 | −0.7891 | 0.0492 | 0.2021 |
| 9 | −0.8219 | 0.0394 | 0.0386 |
| 10 | −0.8647 | 0.0936 | 0.2021 |
| 11 | −0.8338 | 0.1409 | 2.0455 |
| 12 | −0.6010 | 0.3676 | 0.5982 |
| 13 | −0.3266 | 0.4956 | 0.4987 |
| 14 | −0.1135 | 0.4882 | 0.5313 |
| 15 | 0.0839 | 0.3908 | 0.9500 |
| 16 | 0.2339 | 0.2428 | 2.3079 |
| 17 | 0.4220 | −0.0266 | 14.2914 |
| 18 | 0.6113 | −0.3531 | 12.7337 |
| 19 | 0.7814 | −0.6658 | 28.9167 |
| 20 | 1.0514 | −1.1922 | 0.0204 |
| 21 | 1.0164 | −1.2128 | 0. |

CHART XXV
SECTION HT. FROM ROOT: 12.500

| PT. NO. | X | Y | R |
|---|---|---|---|
| 1 | −0.8011 | 0.0772 | 0.0409 |
| 2 | −0.8429 | 0.1379 | 0.2691 |
| 3 | −0.8111 | 0.1825 | 1.5517 |
| 4 | −0.5683 | 0.4052 | 0.5370 |
| 5 | −0.1023 | 0.4896 | 0.5708 |
| 6 | 0.1392 | 0.3368 | 1.8130 |
| 7 | 0.3673 | 0.0362 | 11.0755 |
| 8 | 0.6690 | −0.4937 | 22.9727 |
| 9 | 1.0320 | −1.2037 | 0.0206 |
| 10 | 0.9964 | −1.2245 | 0. |
| 11 | 0.9773 | −1.1967 | 0.6142 |
| 12 | 0.9458 | −1.1458 | −5.2539 |
| 13 | 0.6406 | −0.6588 | −2.9723 |
| 14 | 0.2449 | −0.2041 | −1.4418 |
| 15 | −0.0938 | 0.0324 | −0.8946 |
| 16 | −0.7679 | 0.0851 | 0.2218 |
| 17 | −0.8011 | 0.0772 | 0. |

CHART XXVI
SECTION HT. FROM ROOT: 13.000

| PT. NO. | X | Y | R |
|---|---|---|---|
| 1 | −0.7809 | 0.1134 | 0.0439 |
| 2 | −0.8218 | 0.1813 | 0.3316 |
| 3 | −0.7931 | 0.2185 | 1.3279 |
| 4 | −0.5607 | 0.4248 | 0.5196 |
| 5 | 0.0722 | 0.3951 | 0.6640 |
| 6 | 0.1580 | 0.3077 | 2.7571 |
| 7 | 0.4179 | −0.0723 | 17.6914 |
| 8 | 0.9634 | −1.1123 | 0. |
| 9 | 1.0132 | −1.2152 | 0.0209 |
| 10 | 0.9772 | −1.2362 | 0. |
| 11 | 0.9558 | −1.2051 | 0.5598 |
| 12 | 0.9232 | −1.1519 | −5.1259 |
| 13 | 0.6364 | −0.6809 | −3.2637 |
| 14 | 0.3062 | −0.2736 | −1.7105 |
| 15 | −0.0700 | 0.0236 | −0.9042 |
| 16 | −0.7458 | 0.1195 | 0.2430 |
| 17 | −0.7809 | 0.1134 | 0. |

CHART XXVII
SECTION HT. FROM ROOT: 13.500

| PT. NO. | X | Y | R |
|---|---|---|---|
| 1 | −0.7616 | 0.1494 | 0.0469 |
| 2 | −0.8002 | 0.2252 | 0.4185 |
| 3 | −0.7858 | 0.2425 | 1.1490 |
| 4 | −0.5643 | 0.4380 | 0.5159 |
| 5 | 0.1228 | 0.3383 | 2.7279 |
| 6 | 0.3860 | −0.0434 | 14.4194 |
| 7 | 0.8520 | −0.9302 | 0. |
| 8 | 0.9948 | −1.2266 | 0.0210 |
| 9 | 0.9586 | −1.2478 | 0. |
| 10 | 0.9351 | −1.2139 | 0.5215 |
| 11 | 0.9010 | −1.1574 | −4.6590 |
| 12 | 0.4282 | −0.4254 | −2.0426 |
| 13 | −0.0517 | 0.0157 | −0.9230 |
| 14 | −0.7251 | 0.1533 | 0.2556 |
| 15 | −0.7616 | 0.1494 | 0. |

TABLE I-continued

CHART XXVIII
SECTION HT. FROM ROOT: 14.000

| PT. NO. | X | Y | R |
|---|---|---|---|
| 1 | 0.9402 | −1.2590 | 0. |
| 2 | 0.9067 | −1.2101 | 0.3476 |
| 3 | 0.8841 | −1.1721 | −4.9205 |
| 4 | 0.4434 | −0.4650 | −2.2665 |
| 5 | 0.0387 | −0.0481 | −1.4480 |
| 6 | −0.1157 | 0.0590 | −0.9433 |
| 7 | −0.7058 | 0.1884 | 0.2641 |
| 8 | −0.7425 | 0.1869 | 0.0504 |
| 9 | −0.7805 | 0.2688 | 0.2641 |
| 10 | −0.7604 | 0.2913 | 1.4302 |
| 11 | −0.5834 | 0.4411 | 0.5066 |
| 12 | 0.0383 | 0.4164 | 0.6890 |
| 13 | 0.1458 | 0.3012 | 3.4881 |
| 14 | 0.3418 | 0.0058 | 8.1717 |
| 15 | 0.6035 | −0.4713 | 28.5935 |
| 16 | 0.9771 | −1.2379 | 0.0213 |
| 17 | 0.9402 | −1.2590 | 14.2914 |

CHART XXIX
SECTION HT. FROM ROOT: 14.500

| PT. NO. | X | Y | R |
|---|---|---|---|
| 1 | −0.7256 | 0.2274 | 0.0512 |
| 2 | −0.7585 | 0.3127 | 0.5860 |
| 3 | −0.7455 | 0.3267 | 0.8833 |
| 4 | −0.5509 | 0.4790 | 0.5008 |
| 5 | 0.0715 | 0.3804 | 1.2538 |
| 6 | 0.1919 | 0.2235 | 6.6466 |
| 7 | 0.5621 | −0.4243 | 32.0727 |
| 8 | 0.9594 | −1.2493 | 0.0215 |
| 9 | 0.9212 | −1.2687 | 0. |
| 10 | 0.7833 | −1.0196 | −5.0606 |
| 11 | 0.4248 | −0.4615 | −2.3865 |
| 12 | −0.0526 | 0.0215 | −1.0097 |
| 13 | −0.6902 | 0.2262 | 0.2793 |
| 14 | −0.7256 | 0.2274 | 0. |

CHART XXX
SECTION HT. FROM ROOT: 15.000

| PT. NO. | X | Y | R |
|---|---|---|---|
| 1 | −0.7091 | 0.2702 | 0.0521 |
| 2 | −0.7366 | 0.3589 | 0.6732 |
| 3 | −0.6433 | 0.4346 | 0.6779 |
| 4 | −0.4522 | 0.5379 | 0.4890 |
| 5 | 0.0398 | 0.4084 | 1.0386 |
| 6 | 0.1675 | 0.2461 | 6.9694 |
| 7 | 0.5444 | −0.4246 | 36.9032 |
| 8 | 0.9422 | −1.2605 | 0.0215 |
| 9 | 0.9048 | −1.2815 | 0. |
| 10 | 0.8719 | −1.2328 | 0.4833 |
| 11 | 0.8407 | −1.1794 | −5.3274 |
| 12 | 0.4073 | −0.4625 | −2.4872 |
| 13 | −0.0593 | 0.0293 | −1.0902 |
| 14 | −0.6768 | 0.2664 | 0.2909 |
| 15 | −0.7091 | 0.2702 | 0. |

CHART XXXI
SECTION HT. FROM ROOT: 15.500

| PT. NO. | X | Y | R |
|---|---|---|---|
| 1 | −0.6939 | 0.3138 | 0.0525 |
| 2 | −0.7159 | 0.4043 | 0.7625 |
| 3 | −0.5191 | 0.5289 | 0.5416 |
| 4 | −0.3905 | 0.5669 | 0.4814 |
| 5 | 0.0298 | 0.4163 | 1.0954 |
| 6 | 0.1567 | 0.2490 | 7.4734 |
| 7 | 0.5186 | −0.4096 | 43.0049 |
| 8 | 0.9255 | −1.2714 | 0.0215 |
| 9 | 0.8880 | −1.2924 | 0. |
| 10 | 0.8535 | −1.2407 | 0.5130 |
| 11 | 0.8212 | −1.1852 | −5.5928 |
| 12 | 0.3567 | −0.4178 | −2.5124 |
| 13 | −0.0765 | 0.0459 | −1.1916 |
| 14 | −0.6661 | 0.3083 | 0.2897 |
| 15 | −0.6939 | 0.3138 | 0. |

CHART XXXII
SECTION HT. FROM ROOT: 16.000

| PT. NO. | X | Y | R |
|---|---|---|---|

TABLE I-continued

| | | | |
|---|---|---|---|
| 1 | 0.8722 | −1.3029 | 0. |
| 2 | 0.8334 | −1.2443 | 0.4977 |
| 3 | 0.8040 | −1.1935 | −6.3697 |
| 4 | 0.5367 | −0.7149 | −5.1108 |
| 5 | 0.2674 | −0.3205 | −2.4060 |
| 6 | −0.1200 | 0.0855 | −1.2939 |
| 7 | −0.6560 | 0.3503 | 0.2809 |
| 8 | −0.6796 | 0.3568 | 0.0537 |
| 9 | −0.6940 | 0.4517 | 0.2809 |
| 10 | −0.6883 | 0.4557 | 1.0520 |
| 11 | −0.5217 | 0.5464 | 0.4715 |
| 12 | −0.0049 | 0.4510 | 0.7984 |
| 13 | 0.1126 | 0.3057 | 5.2443 |
| 14 | 0.2793 | 0.0218 | 8.8560 |
| 15 | 0.4751 | −0.3584 | 49.1312 |
| 16 | 0.8796 | −1.2171 | 0. |
| 17 | 0.9096 | −1.2822 | 0.0215 |
| 18 | 0.8722 | −1.3029 | 12.7337 |

CHART XXXIII
SECTION HT. FROM ROOT: 16.500

| PT. NO. | X | Y | R |
|---|---|---|---|
| 1 | −0.6683 | 0.3990 | 0.0532 |
| 2 | −0.6765 | 0.4934 | 0.7668 |
| 3 | −0.4894 | 0.5784 | 0.4832 |
| 4 | 0.0300 | 0.4139 | 1.3698 |
| 5 | 0.1500 | 0.2332 | 11.5747 |
| 6 | 0.4773 | −0.4019 | 73.4770 |
| 7 | 0.8945 | −1.2921 | 0.0216 |
| 8 | 0.8570 | −1.3133 | 1.3708 |
| 9 | 0.7682 | −1.1629 | −6.3780 |
| 10 | 0.2901 | −0.3693 | −2.8038 |
| 11 | −0.0921 | 0.0678 | −1.4670 |
| 12 | −0.6464 | 0.3911 | 0.2872 |
| 13 | −0.6683 | 0.3990 | 0. |

CHART XXXIV
SECTION HT. FROM ROOT: 17.000

| PT. NO. | X | Y | R |
|---|---|---|---|
| 1 | −0.6582 | 0.4403 | 0.0537 |
| 2 | −0.6593 | 0.5359 | 0.7172 |
| 3 | −0.4731 | 0.6033 | 0.4966 |
| 4 | 0.0298 | 0.4118 | 1.4989 |
| 5 | 0.1542 | 0.2115 | 21.4950 |
| 6 | 0.5392 | −0.5722 | 0. |
| 7 | 0.8797 | −1.3023 | 0.0214 |
| 8 | 0.8426 | −1.3234 | 1.4573 |
| 9 | 0.7500 | −1.1665 | −7.0641 |
| 10 | 0.2803 | −0.3756 | −3.1808 |
| 11 | −0.0792 | 0.0601 | −1.6407 |
| 12 | −0.6363 | 0.4304 | 0.2957 |
| 13 | −0.6582 | 0.4403 | 0. |

CHART XXXV
SECTION HT. FROM ROOT: 17.500

| PT. NO. | X | Y | R |
|---|---|---|---|
| 1 | −0.6501 | 0.4818 | 0.0543 |
| 2 | −0.6438 | 0.5781 | 0.6579 |
| 3 | −0.4572 | 0.6284 | 0.5196 |
| 4 | 0.0321 | 0.4048 | 1.7397 |
| 5 | 0.1625 | 0.1787 | 97.0736 |
| 6 | 0.6838 | −0.9240 | 0. |
| 7 | 0.8647 | −1.3129 | 0.0212 |
| 8 | 0.8280 | −1.3337 | 1.5807 |
| 9 | 0.7312 | −1.1696 | −8.1195 |
| 10 | 0.2882 | −0.4086 | −3.8499 |
| 11 | −0.0548 | 0.0382 | −1.8265 |
| 12 | −0.6260 | 0.4688 | 0.2962 |
| 13 | −0.6501 | 0.4818 | 0. |

CHART XXXVI
SECTION HT. FROM ROOT: 18.000

| PT. NO. | X | Y | R |
|---|---|---|---|
| 1 | 0.8128 | −1.3443 | 0. |
| 2 | 0.7652 | −1.2710 | 0.5986 |
| 3 | 0.7336 | −1.2164 | −10.1035 |
| 4 | 0.4378 | −0.6776 | −7.8370 |
| 5 | 0.1935 | −0.2893 | −3.8073 |
| 6 | −0.0830 | 0.0737 | −1.9454 |
| 7 | −0.6147 | 0.5061 | 0.2895 |
| 8 | −0.6436 | 0.5244 | 0.0553 |

TABLE I-continued

| | | | |
|---|---|---|---|
| 9 | −0.6278 | 0.6221 | 0.2895 |
| 10 | −0.6184 | 0.6248 | 0.8979 |
| 11 | −0.5082 | 0.6479 | 0.5443 |
| 12 | 0.0187 | 0.4171 | 1.5269 |
| 13 | 0.1451 | 0.1950 | 0. |
| 14 | 0.8487 | −1.3244 | 0.0206 |
| 15 | 0.8128 | −1.3443 | 49.1312 |

CHART XXXVII
SECTION HT. FROM ROOT: 18.500

| PT. NO. | X | Y | R |
|---|---|---|---|
| 1 | −0.6389 | 0.5695 | 0.0550 |
| 2 | −0.6163 | 0.6650 | 0.5903 |
| 3 | −0.0253 | 0.4688 | 0.7325 |
| 4 | 0.0418 | 0.3739 | 1.7875 |
| 5 | 0.1321 | 0.2010 | 0. |
| 6 | 0.8313 | −1.3369 | 0.0201 |
| 7 | 0.7961 | −1.3563 | 0. |
| 8 | 0.7565 | −1.2956 | 0.8941 |
| 9 | 0.7098 | −1.2151 | −12.4411 |
| 10 | 0.3369 | −0.5405 | −6.8324 |
| 11 | −0.0158 | −0.0054 | −2.1256 |
| 12 | −0.5971 | 0.5389 | 0.3802 |
| 13 | −0.6389 | 0.5695 | 0. |

CHART XXXVIII
SECTION HT. FROM ROOT: 19.000

| PT. NO. | X | Y | R |
|---|---|---|---|
| 1 | −0.6353 | 0.6156 | 0.0555 |
| 2 | −0.6041 | 0.7099 | 0.5435 |
| 3 | −0.4856 | 0.7141 | 0.6398 |
| 4 | 0.0195 | 0.3988 | 2.0589 |
| 5 | 0.1223 | 0.1984 | 0. |
| 6 | 0.8126 | −1.3502 | 0.0196 |
| 7 | 0.7782 | −1.3688 | 0. |
| 8 | 0.7373 | −1.3056 | 0.9929 |
| 9 | 0.6886 | −1.2217 | −16.6027 |
| 10 | 0.3384 | −0.5780 | −9.9262 |
| 11 | −0.0104 | −0.0137 | −2.2100 |
| 12 | −0.5871 | 0.5753 | 0.3596 |
| 13 | −0.6353 | 0.6156 | 0. |

CHART XXXIX
SECTION HT. FROM ROOT: 19.500

| PT. NO. | X | Y | R |
|---|---|---|---|
| 1 | −0.6322 | 0.6622 | 0.0568 |
| 2 | −0.5923 | 0.7558 | 0.4567 |
| 3 | −0.4983 | 0.7515 | 0.7052 |
| 4 | 0.0153 | 0.3925 | 2.5090 |
| 5 | 0.1133 | 0.1927 | 0. |
| 6 | 0.7930 | −1.3640 | 0.0190 |
| 7 | 0.7595 | −1.3818 | 0. |
| 8 | 0.7123 | −1.3078 | 0.9676 |
| 9 | 0.6726 | −1.2396 | 0. |
| 10 | 0.5326 | −0.9745 | −18.5725 |
| 11 | −0.0078 | −0.0207 | −2.2696 |
| 12 | −0.5807 | 0.6137 | 0.3272 |
| 13 | −0.6322 | 0.6622 | 0. |

CHART XL
SECTION HT. FROM ROOT: 19.835

| PT. NO. | X | Y | R |
|---|---|---|---|
| 1 | 0.7471 | −1.3912 | 0. |
| 2 | 0.6876 | −1.2966 | 0.7000 |
| 3 | 0.6592 | −1.2472 | −38.3583 |
| 4 | 0.0479 | −0.1206 | −4.6443 |
| 5 | −0.0683 | 0.0740 | −2.2500 |
| 6 | −0.5771 | 0.6396 | 0.3065 |
| 7 | −0.6301 | 0.6933 | 0.0585 |
| 8 | −0.5844 | 0.7875 | 0.3065 |
| 9 | −0.5289 | 0.7831 | 0.7500 |
| 10 | −0.0246 | 0.4495 | 0.9542 |
| 11 | 0.0163 | 0.3794 | 2.5393 |
| 12 | 0.1034 | 0.1977 | 0. |
| 13 | 0.7800 | −1.3739 | 0.0187 |
| 14 | 0.7471 | −1.3912 | 0.0206 |

CHART XLI
SECTION HT. FROM ROOT: 19.835

| PT. NO. | X | Y | R |
|---|---|---|---|
| 1 | −0.6419 | 0.7225 | 0.0585 |

TABLE I-continued

| | | | |
|---|---|---|---|
| 2 | −0.5844 | 0.7875 | 0.3065 |
| 3 | −0.5288 | 0.7831 | 0.7500 |
| 4 | −0.4414 | 0.7627 | 0. |
| 5 | −0.1236 | 0.6680 | 0.5000 |
| 6 | 0.1866 | 0.4007 | 0. |
| 7 | 0.7934 | −0.8965 | 0.2150 |
| 8 | 0.8129 | −1.0057 | 0. |
| 9 | 0.7812 | −1.3823 | 0.0187 |
| 10 | 0.7521 | −1.3961 | 0. |
| 11 | 0.4426 | −1.1849 | 0.2150 |
| 12 | 0.3771 | −1.1138 | 0. |
| 13 | −0.6039 | 0.6059 | 0.3030 |
| 14 | −0.6419 | 0.7225 | 0. |
| | (Build-up section) | | |

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A bucket for a steam turbine having a profile in accordance with Charts I-XIX; XXI-XXXIX; and XLI inclusive of Table I.

2. The bucket according to claim 1 having a theoretical aerodynamic profile according to Chart XX of Table I.

3. The bucket according to claim 1 having a theoretical aerodynamic profile according to Chart XL of Table I.

4. The bucket according to claim 3 having a theoretical aerodynamic profile according to Chart XX of Table I.

5. A plurality of buckets constructed in accordance with claim 1 spaced circumferentially about an axis and having tips, and means for continuously coupling said tips one to the other about said axis.

6. The buckets according to claim 5 including a plurality of inner covers connecting the tips of adjacent pairs of buckets one to the other and a plurality of outer covers connecting adjacent ones of adjacent pairs of said buckets one to the other and in radially overlying relation to said inner covers.

7. A plurality of buckets according to claim 6 including a sealing rib projecting radially from said outer covers forming an annular sealing ring about the tips of said buckets.

8. A bucket according to claim 1 wherein said bucket has a root connected to a dovetail, said dovetail having a projection and a corresponding recess on circumferentially opposite sides thereof.

9. A bucket for a steam turbine having a profile in accordance with the Charts I-XVIII; and XX-XL inclusive of Table 1.

* * * * *